US005203058A

United States Patent [19]

Krauss

[11] Patent Number: 5,203,058

[45] Date of Patent: Apr. 20, 1993

[54] TWIN BUCKLE FOR FASTENING STRAPS AND THE LIKE

[75] Inventor: Mark Krauss, E. Greenwich, R.I.

[73] Assignee: American Cord & Webbing Co., Inc., Woonsocket, R.I.

[21] Appl. No.: 877,084

[22] Filed: May 1, 1992

[51] Int. Cl.[5] ..... A44B 11/00

[52] U.S. Cl. ..... 24/575; 24/576; 24/616

[58] Field of Search ..... 24/575, 576, 578, 587, 24/616, 615, 625, 633, 634, 577

[56] References Cited

U.S. PATENT DOCUMENTS

| | | | |
|---|---|---|---|
| 2,406,895 | 9/1946 | Olson . | |
| 3,520,033 | 7/1970 | Usuda . | |
| 3,979,801 | 9/1976 | Tareau | 24/575 |
| 4,052,774 | 10/1977 | Noda . | |
| 4,150,464 | 4/1979 | Tracy | 24/615 |
| 4,171,555 | 10/1979 | Bakker et al. . | |
| 4,569,106 | 2/1986 | Lovato | 24/615 |
| 4,577,377 | 3/1986 | Kasai . | |
| 4,621,393 | 11/1986 | Ambal | 24/576 |
| 4,660,259 | 4/1987 | Ausnit . | |
| 4,672,725 | 6/1987 | Kasai | 24/625 |
| 4,688,337 | 8/1987 | Dillner et al. | 24/615 |
| 4,779,315 | 10/1988 | Kohus | 24/575 |

FOREIGN PATENT DOCUMENTS

| | | | |
|---|---|---|---|
| 2574262 | 6/1986 | France | 24/616 |

*Primary Examiner*—Victor N. Sakran

[57] ABSTRACT

A snap fastener comprising two pieces of idential contruction having adjacently positioned respective male and female members which are axially inserted with respect to each other into a locking engagement.

9 Claims, 2 Drawing Sheets

TWIN BUCKLE FOR FASTENING STRAPS AND THE LIKE

FIELD OF THE INVENTION

The present invention relates to a twin buckle for fastening straps and the like, having identical twin parts with respective male and female members.

BACKGROUND OF THE INVENTION

Their exists many designs of buckles or fasteners in the prior art. Same of the design of the buckles involve the use of a male member adapted to engage a female member. Examples of this type can be seen in U.S. Pat. Nos. 3,979,801, 4,150,464 and 4,672,725. Other types of buckles are constructed of identical members intended to interlock respective male and female members on respective pieces. Examples of this type can be seen in U.S. Pat. Nos. 4,569,106, 4,621,393 and 4,779,315. The latter type of buckles has the advantage of simplying manufacturing thereof since each member is identical thus avoiding the use of two different molds. In addition, because the buckles are identical, their use on garments, cases and the like is also simplified since there can be little room for error in attaching them thereto, in mistakenly affixing a male/male as female/female portions.

While such type buckles have been found in many applications, it is desirable to improve further on the simplicity of their construction and the effectiveness in their fastening.

SUMMARY OF THE INVENTION

It is therefore an object of the invention to provide for a buckle as fastener which has an improved design over prior art buckles.

In this regard the present invention provides for a buckle formed out of two idential parts which include both male and female members. In this regard each part is formed integrally preferable of a plastic material and includes a longitudinally extending arm. This arm includes thereon a snap or locking member positioned adjacent to a sleeve member having an opening therein to receive the arm and locking member of the opposite piece.

To lock the fastener, each piece is axially aligned and pushed together causing the arm and locking member to enter the respective sleeves to a point that the locking members snap into openings in the respective sleeves. Since the arms are positioned back to back, this adds to the integrity of the buckle. To release the buckle, a squeezing force is placed on the locking member causing it to disengage from the opening and allows the parts to be separated. An additional embodiment of the invention is also disclosed.

Thus the construction of the fastener of the present invention provides for a simplified design, readily molded and strong in integrity.

BRIEF DESCRIPTION OF THE DRAWINGS

Thus by the present invention, its objects and advantages will be realized, the description of which should be taken in conjunction with the drawings, wherein.

DETAIL DESCRIPTION OF THE PREFERRED EMBODIMENT

Figure 1:
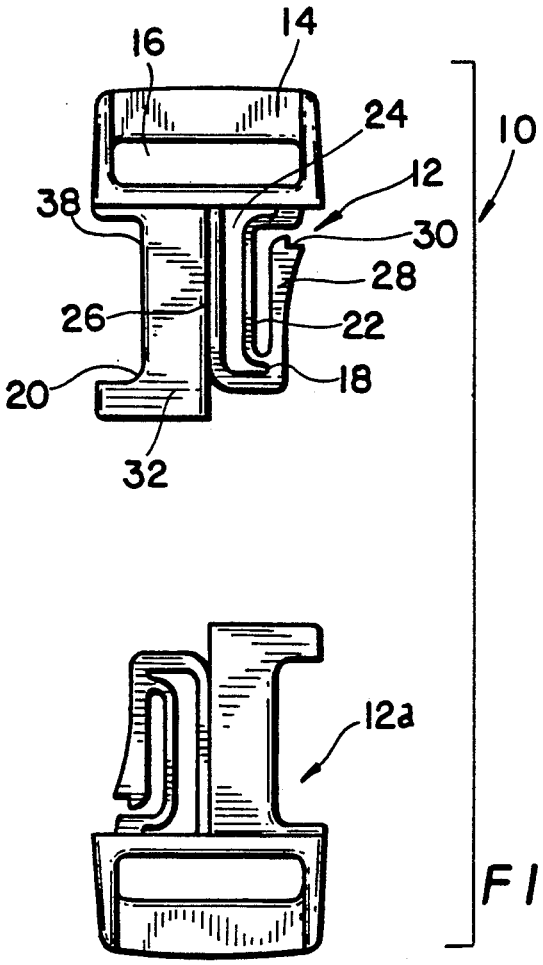
FIG. 1 is a side perspective view of the buckle shown prior to coupling, incorporating the teachings of the present invention.

Turning now more particularly to the drawings, in the first embodiment there is shown a two piece buckle 10. Each piece 12 and 12A are identical in construction and accordingly comments and description with regard to one, equally apply to the other.

Piece 12 is integrally constructed preferrably out of a plastic resin or other material suitable for purpose. Provide on piece 12 is a loop or strap receiving member 14 to which a strap may be attached by passing through slot 16 and securing it in a conventional manner. Coupled to the portion 14 are respective male 18 and female 20 members. Male member 18 includes a somewhat U-shaped portion 22 which includes a straight member 24 having a flat side 26 and a snap or latching member 28. Member 28 is flexibly coupled to member 24 and includes a locking surface 30.

Positioned parallel to member 18 is female member 20 comprising a sleeve 32. Sleeve 32 includes oppositely disposed walls 34 with wall 36 disposed on one side there between. A U-shaped cut out 38 is provided and includes an opening 40 therein and a locking surface 42 is also provided.

Figure 2:
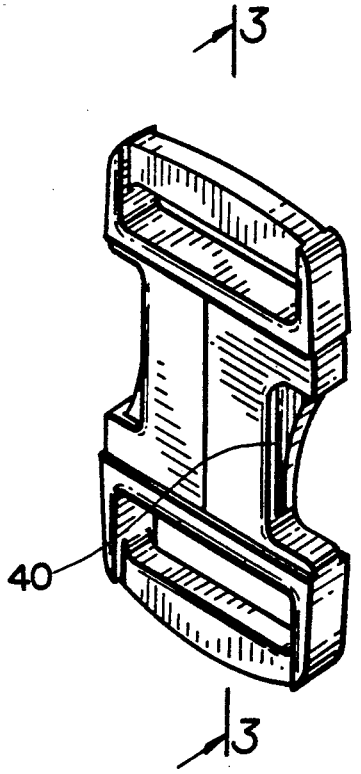
FIG. 2 is a perspective view of buckle shown with the two parts coupled together, incorporating the teachings of the present invention.
Figure 3:
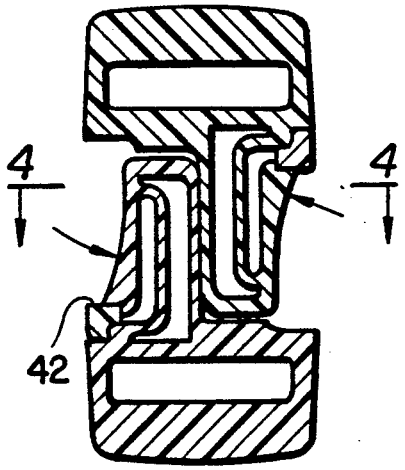
FIG. 3 is a sectional view taken along lines 3—3 of FIG. 2.
Figure 4:
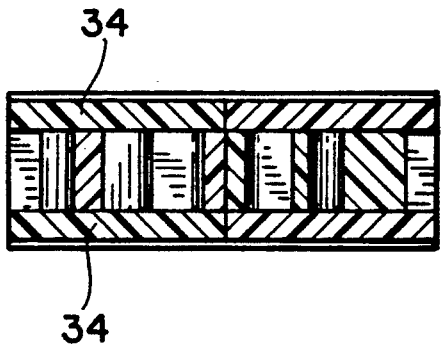
FIG. 4 is a sectional view taken along lines 4—4 of FIG. 3.

As can best be seen in FIGS. 1–4, pieces 12 and 12A are intended to be coupled together by axially inserting member 18 into member 20A, member 18A into member 20. In this regard, the flat sides 26 and 26A slidingly engage each other during the insertion, to a point that the snap members 28 and 28A snap into their respective openings 40 and 40A locking the pieces 12 and 12A together. To separate the pieces, a squeezing force is applied to members 28 and 28A disengaging them from locking surface 42 allowing the pieces to be separated by axially sliding them apart.

Figure 5:
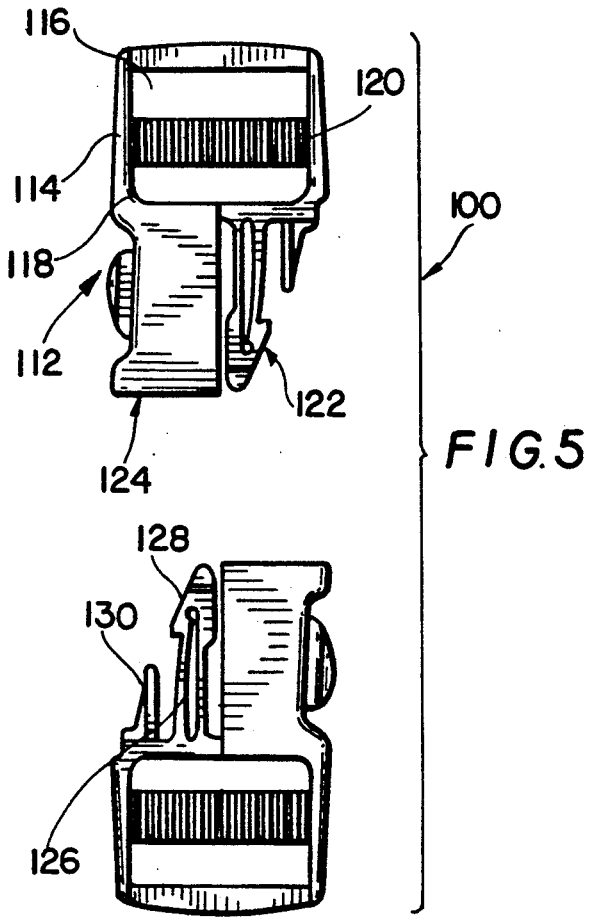
FIG. 5 is a side perspective view of a second embodiment of the invention shown prior to coupling incorporating the teachings of the present invention.
Figure 6:
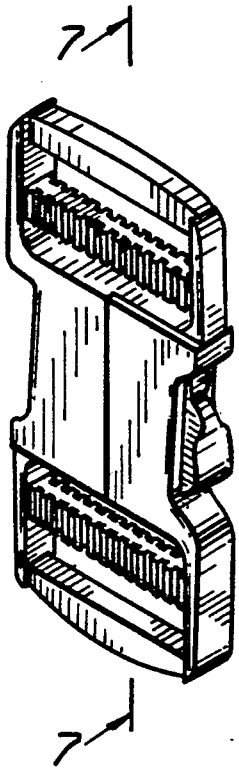
FIG. 6 is a perspective view of buckle shown with the two parts coupled together, incorporating the teachings of the present invention.
Figure 7:
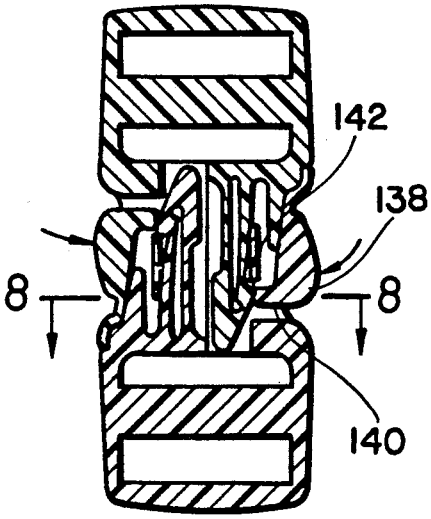
FIG. 7 is a sectional view taken along lines 7—7 of FIG. 6.
Figure 8:
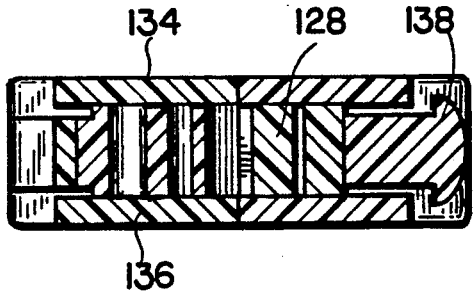
FIG. 8 is a sectional view taken along lines 8—8 of FIG. 7.

Turning now to FIGS. 5–8 another embodiment of the present invention is shown. In this regard the buckle 100 comprises two pieces 112 and 112A which are identical in construction and again comments and description with regard to one equally applies to the other.

Piece 112 is integrally constructed preferrably out of a plastic resin or other material suitable for purpose. A strap receiving member 114 is provided and includes two loops 116 and 118 along with a serrated member 120 there between. A strap can be fastened in any known fashion. Piece 112 includes both male 122 and female 124 members.

The male member 122 comprises a snap action latching or locking member 126 axially extending from member 114 and includes a hook portion 128. Positioned adjacent member 126 is an axial member 130 which serves to about the female member 124 as will be discussed. In this regard female member 124 comprises a sleeve 132 having opposite walls 134 and a side wall 136 disposed there between. Side wall 136 includes a flexible unlocking or button member 138 which has a portion 140 which extends with the sleeve. A latching surface 142 is provided in the sleeve to latch hook portion 128 as seen most clearly in FIG. 7. When coupled together member 130 is disposed in and abuts sleeve 132.

To disengage the pieces, a squeezing force is placed upon button member 138 which causes portion 140 to engage the hook portion 128 releasing it from latching surface 142. The pieces can then be axially slided apart.

Thus by the present invention its objects and advantages are realized and although preferred embodiments have been disclosed and described in detail herein, its scope should not be limited thereby, rather its scope should be determined by that of the amended claims.

What is claimed:

1. A snap fastener comprising two identical pieces having respective male and female members positioned adjacent each other and adapted to engage in a male female relationship by the axial insertion of one in the other, a said male member comprising an axially extending latching member having a combined locking portion and a guide portion somewhat centrally positioned with the guide portion comprising a flat surface positioned adjacent the female member, said latching member being flexible and biased into a locking position; said female member comprising a U-shaped sleeve including a cut out to receive the locking portion of the latching member to lock the two pieces together when the latching member is fully inserted therein, said latching member includes a portion which extends beyond the sleeve when in the latched position, and wherein said pieces are joined together by axially sliding the respective flat sides together to a point that the latching member locks in the cut out and the separation of the pieces is implemented by a squeezing force placed upon the respective portions of the latching members which extend beyond the sleeve.

2. The invention in accordance with claim 1 wherein said pieces include means to couple a strap or the like thereto.

3. The invention in accordance with claim 2 wherein said pieces are integrally constructed.

4. The invention in accordance with claim 3 wherein said pieces are constructed of a plastic material.

5. A snap fastener comprising two identical pieces having respective male and female members positioned adjacent each other and adapted to engage in a male female relationship by the axial insertion of one in the other, a said male member comprising an axially extending latching member having a hook portion, and being somewhat centrally located on the piece, said latching member being flexible and biased into a locking position; said female member comprising a U-shaped sleeve including a latching surface located within the sleeve to receive a portion of the latching member to lock the two pieces together when the latching member is fully inserted therein, said female member includes an unlocking portion which is moveable with respect to the sleeve and extends inside thereof, and wherein said pieces are joined together by axially sliding the respective pieces together to a point that the latching member engages the latching surface and locks said members together with the separation of the pieces being implemented by a squeezing force placed upon the unlocking portion which extends into the sleeve to engage the hook portion to disengage the hook portion from the latching surface.

6. The invention in accordance with claim 5 which includes support member positioned adjacent said latching member away from said sleeve member which is adapted to engage said sleeve member when positioned therein.

7. The invention in accordance with claim 6 wherein said pieces include means to couple a strap or the like thereto.

8. The invention in accordance with claim 7 wherein said pieces are integrally constructed.

9. The invention in accordance with claim 8 wherein said pieces are constructed of a plastic material.

* * * * *